US012454788B2

(12) United States Patent
Murphy et al.

(10) Patent No.: US 12,454,788 B2
(45) Date of Patent: Oct. 28, 2025

(54) LAUNDRY APPLIANCE

(71) Applicant: WHIRLPOOL CORPORATION, Benton Harbor, MI (US)

(72) Inventors: Sayer James Murphy, St. Joseph, MI (US); Anne Wessel, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 434 days.

(21) Appl. No.: 17/811,702

(22) Filed: Jul. 11, 2022

(65) Prior Publication Data

US 2023/0016957 A1 Jan. 19, 2023

Related U.S. Application Data

(60) Provisional application No. 63/221,216, filed on Jul. 13, 2021.

(51) Int. Cl.

| | |
|---|---|
| ***D06F 58/22*** | (2006.01) |
| ***D06F 58/36*** | (2020.01) |
| ***D06F 105/30*** | (2020.01) |
| ***D06F 105/34*** | (2020.01) |

(52) U.S. Cl.

CPC ..... *D06F 58/22* (2013.01); *D06F 58/36* (2020.02); *D06F 2105/30* (2020.02); *D06F 2105/34* (2020.02)

(58) Field of Classification Search

CPC ..... D06F 58/22; D06F 58/36; D06F 2105/30; D06F 2105/34; D06F 58/45; D06F 2103/00

See application file for complete search history.

(56) References Cited

U.S. PATENT DOCUMENTS

| | | | |
|---|---|---|---|
| 3,718,982 | A | 3/1973 | Deaton |
| 4,700,492 | A | 10/1987 | Werner et al. |
| 10,280,552 | B2 | 5/2019 | Kulkarni |
| 10,633,785 | B2 | 4/2020 | Bocchino |
| 10,781,550 | B2 | 9/2020 | Mazzarella et al. |
| 2009/0064528 | A1 | 3/2009 | Kim |

(Continued)

FOREIGN PATENT DOCUMENTS

| | | | |
|---|---|---|---|
| CN | 110409154 | A | 11/2019 |
| CN | 211772213 | U | 10/2020 |

(Continued)

OTHER PUBLICATIONS

Translation, EP-2145999-A1 (Year: 2010).*

(Continued)

*Primary Examiner* — Jessica Yuen

(74) *Attorney, Agent, or Firm* — Price Heneveld LLP

(57) ABSTRACT

A laundry appliance includes a first lint filter operable between a use position and a maintenance position, a second lint filter proximate to the first lint filter, a switch operable between a first condition and a second condition, and a blower. Movement of the first lint filter from the use position to the maintenance position prompts the switch to enter the second condition from the first condition. The blower is operable to deliver process air through the first and second lint filters in the first condition of the switch and is configured to activate to deliver process air through the second lint filter based on the switch entering the second condition.

20 Claims, 6 Drawing Sheets

(56) References Cited

U.S. PATENT DOCUMENTS

| | | | |
|---|---|---|---|
| 2009/0136626 | A1 | 5/2009 | Mueller |
| 2019/0143154 | A1 | 5/2019 | Gangadhar et al. |
| 2019/0351459 | A1 | 11/2019 | Dal Molin et al. |
| 2020/0340170 | A1 | 10/2020 | MacDonald, III et al. |

FOREIGN PATENT DOCUMENTS

| | | | | | |
|---|---|---|---|---|---|
| DE | 102015110215 | A1 | | 12/2016 | |
| EP | 2145999 | A1 | * | 1/2010 | ..... D06F 58/22 |
| EP | 2273005 | A2 | | 1/2011 | |
| EP | 2843125 | A1 | | 3/2015 | |
| EP | 3090094 | | | 7/2015 | |
| EP | 3234255 | | | 6/2016 | |
| EP | 3562987 | | | 7/2018 | |
| EP | 3562989 | | | 7/2018 | |
| EP | 2647755 | B1 | * | 10/2018 | ..... D06F 58/22 |
| JP | 2016165357 | A | * | 9/2016 | |
| KR | 20060042635 | A | * | 5/2006 | ..... D06F 58/22 |
| WO | 2016034302 | A1 | | 3/2016 | |

OTHER PUBLICATIONS

Translation, JP-2016165357-A (Year: 2016).*
Translation, KR-20060042635-A (Year: 2006).*
Commonly assigned co-pending U.S. Appl. No. 17/342,656, filed Jun. 9, 2021, including filing receipt, application and drawings.

* cited by examiner

LAUNDRY APPLIANCE

CROSS-REFERENCE TO RELATED APPLICATIONS

The present application claims priority to U.S. Provisional Patent Application No. 63/221,216, filed Jul. 13, 2021, entitled LAUNDRY APPLIANCE, the entire disclosure of which is hereby incorporated herein by reference.

BACKGROUND OF THE DISCLOSURE

The present disclosure generally relates to a laundry appliance and, more specifically, to a laundry appliance that includes a lint filter.

SUMMARY OF THE DISCLOSURE

According to one aspect of the present disclosure, a laundry appliance includes a first lint filter operable between a use position and a maintenance position, a second lint filter proximate to the first lint filter, a switch operable between a first condition and a second condition, and a blower. Movement of the first lint filter from the use position to the maintenance position prompts the switch to enter the second condition from the first condition. The blower is operable to deliver process air through the first and second lint filters in the first condition of the switch and is configured to activate to deliver process air through the second lint filter based on the switch entering the second condition.

According to another aspect of the present disclosure, a laundry appliance includes a first lint filter operable between a use position and a maintenance position, a second lint filter proximate to the first lint filter, a switch operable between a first condition and a second condition, and a blower configured to deliver process air through the second lint filter in the second condition of the switch. Movement of the first lint filter from the use position to the maintenance position prompts the switch to enter the second condition.

According to yet another aspect of the present disclosure, a laundry appliance includes a blower for delivering process air through an air flow path, and a first lint filter operable between a use position and a maintenance position. In the use position, the first lint filter is positioned within the air flow path. In the maintenance position, the first lint filter is positioned such that captured particulate matter is accessible for removal from the first lint filter by a user. Movement of the first lint filter from the use position to the maintenance position prompts activation of the blower.

These and other features, advantages, and objects of the present disclosure will be further understood and appreciated by those skilled in the art by reference to the following specification, claims, and appended drawings.

Figure 1:
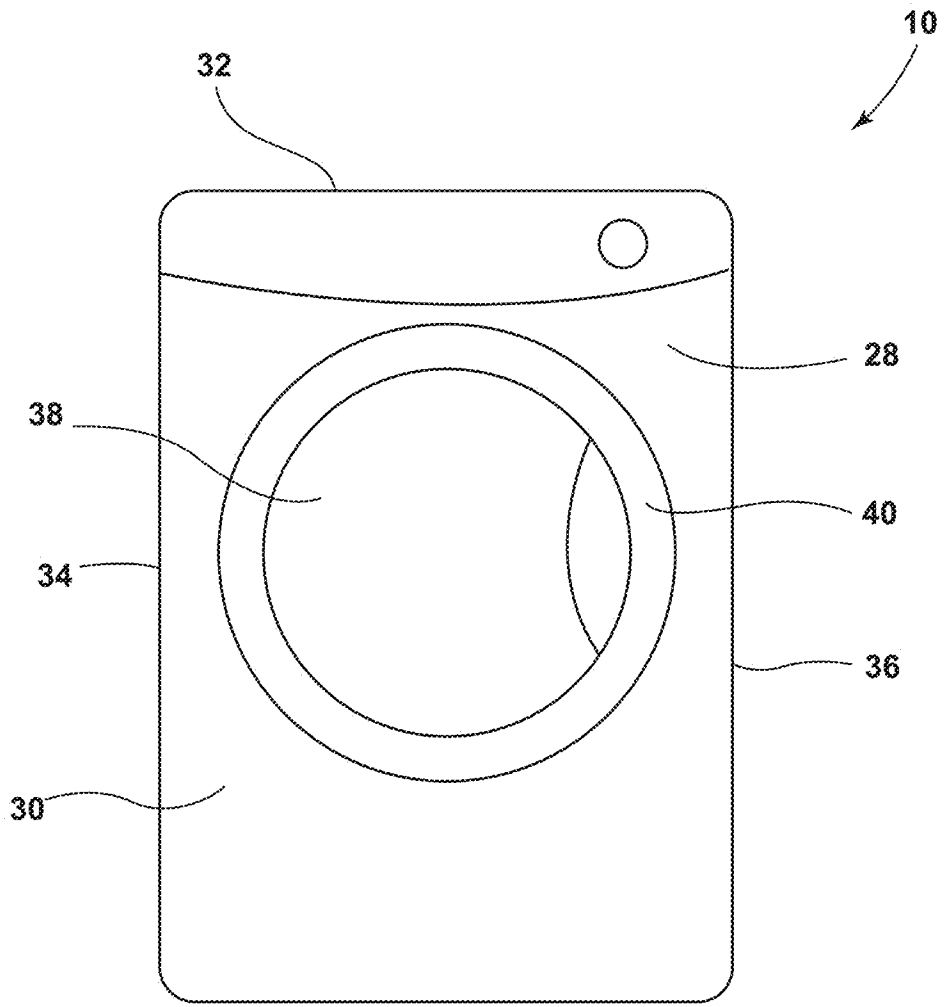
FIG. 1 is a front elevational view of a laundry appliance.

The components in the figures are not necessarily to scale, emphasis instead being placed upon illustrating the principles described herein.

DETAILED DESCRIPTION

The present illustrated embodiments reside primarily in combinations of apparatus components related to a laundry appliance. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, reference numeral 10 generally designates a laundry appliance. The laundry appliance 10 can include various mechanisms for washing, drying, or otherwise processing laundry. Typically, the laundry appliance 10 includes a drum 12 that is configured to rotate to process laundry within the drum 12. A blower 14 is disposed within the laundry appliance 10 and delivers process air 16 through an airflow path 18 of the laundry appliance 10. The blower 14 can be a fan, an air handling unit, or other air-moving device that can move process air 16 through the drum 12 using positive pressure or negative pressure via an induced flow of process air 16 through the drum 12. The airflow path 18 can include various air-conditioning mechanisms 20. These air-conditioning mechanisms 20 can include one or more heat exchangers, electrical heaters, and other similar mechanisms that serve to heat and, in certain applications, cool the process air 16 within the laundry appliance 10. At least a first lint filter 22 is positioned within the airflow path 18 and is configured to filter particulate matter 24, such as lint particles, from the process air 16.

Figure 5:
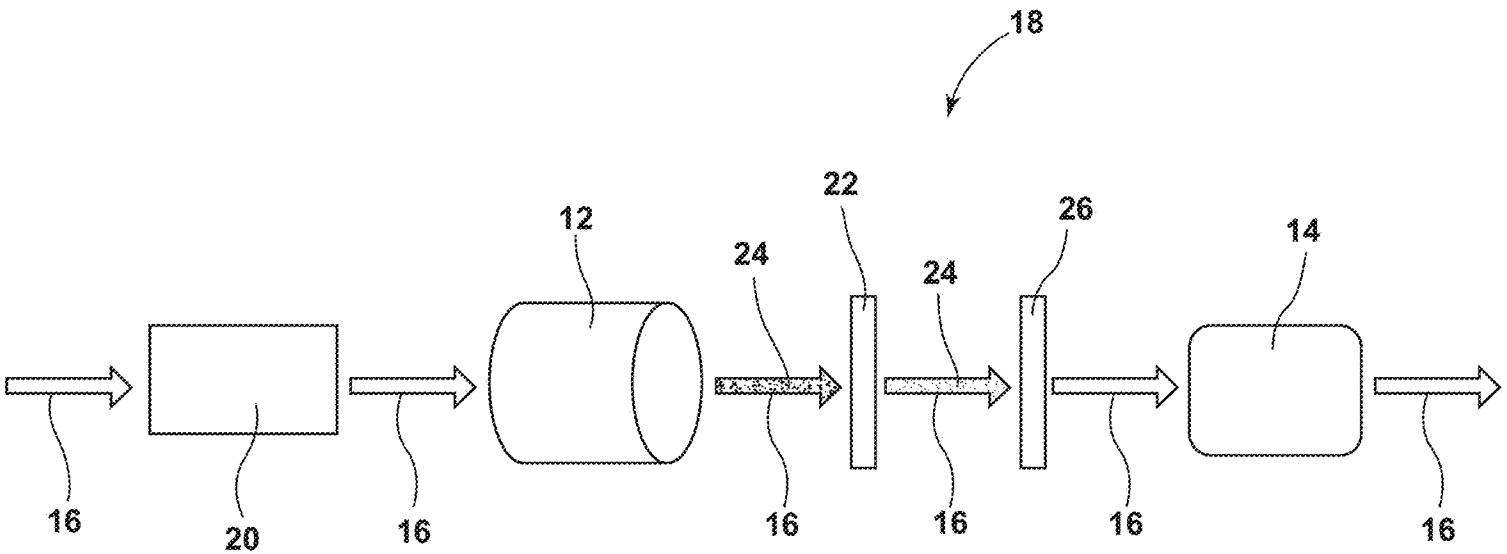
FIG. 5 is a schematic diagram of an airflow path for a laundry appliance including first and second lint filters.

In the embodiment illustrated in FIG. 5, the process air 16 entering the airflow path 18 is initially drawn past the air-conditioning mechanism 20 that heats the process air 16. Next, the process air 16 is delivered to the drum 12. The combination of the process air 16 and particulate matter 24 from within the drum 12 flows out of the drum 12 and through the first lint filter 22. The first lint filter 22 filters at least some of the particulate matter 24 from the process air 16. Next, the process air 16 and any remaining particulate matter 24 within the process air 16 is delivered to a second lint filter 26. The second lint filter 26 further filters the particulate matter 24 from the process air 16. Finally, the process air 16 is expelled from the laundry appliance 10 by the blower 14. In certain aspects of the device, the filtered process air 16 can be recirculated through the airflow path 18.

Figure 2B:
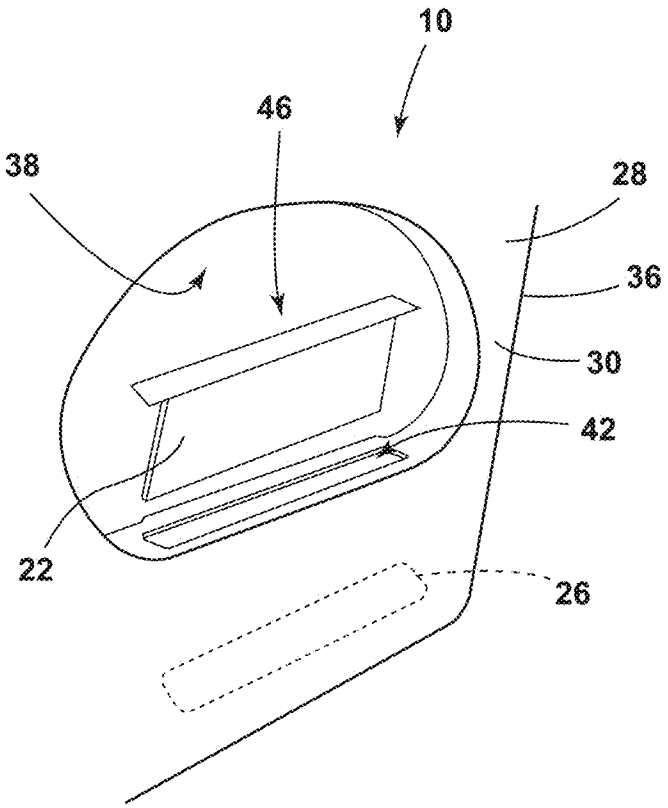
FIG. 2B is a top perspective view of a portion of a laundry appliance illustrating a first lint filter in a maintenance position.

Referring now to FIGS. 1-2B, the laundry appliance 10 includes a cabinet 28. The cabinet 28 includes a front side 30 and a rear side (not shown) that is opposite the front side 30. A top side 32 extends between the front side 30 and the rear side. Left and right sides 34, 36 extend downward from the top side 32 in between the front side 30 and the rear side. In various embodiments, the cabinet 28 of the laundry appliance 10 houses a variety of appliance components. For example, the drum 12 of the laundry appliance 10 is housed within the cabinet 28.

Figure 2A:
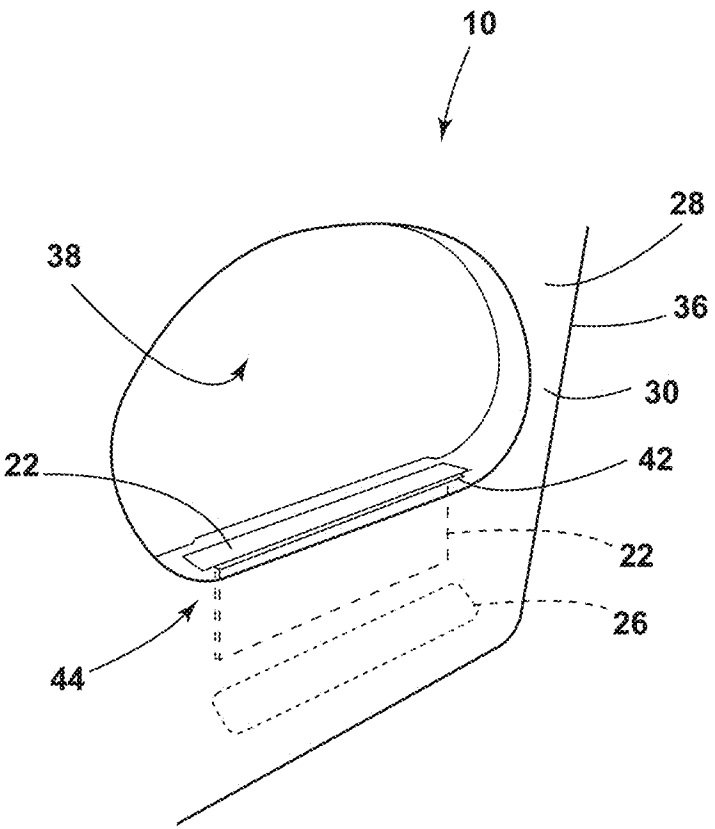
FIG. 2A is a top perspective view of a portion of a laundry appliance illustrating a first lint filter in a use position.

In various embodiments, the front side 30 of the cabinet 28 defines an opening 38, as illustrated in FIGS. 2A and 2B. The drum 12 housed within the cabinet 28 is accessible via the opening 38 defined by the front side 30 of the cabinet 28. As illustrated in FIG. 1, the laundry appliance 10 includes a door 40 that is coupled to the cabinet 28 and operable to cover the opening 38 in a closed position and reveal the opening 38 in an open position.

Referring now to FIGS. 2A and 2B, the laundry appliance 10 includes the first lint filter 22. The first lint filter 22 can be positioned proximate to the front side 30 of the cabinet 28. In various implementations, the first lint filter 22 is positioned downward of the opening 38 defined by the front side 30 of the cabinet 28. In the embodiment illustrated in FIGS. 2A and 2B, a first lint filter housing 42 is defined by the front side 30 of the cabinet 28 below the opening 38. The first lint filter housing 42 is configured to receive the first lint filter 22 therein, in some embodiments, as described further herein.

Referring now to FIGS. 2A and 2B, the first lint filter 22 is operable between a use position 44 and a maintenance position 46. In the use position 44, the first lint filter 22 is positioned within the airflow path 18, such that particulate matter 24 is filtered from the process air 16 that is delivered through the first lint filter 22. In the maintenance position 46, the first lint filter 22 is positioned such that captured particulate matter 24 is accessible for removal from the first lint filter 22 by a user. It is contemplated that the first lint filter 22 can move between the use and maintenance positions 44, 46 in a variety of manners, in various embodiments (e.g., pivoting, sliding, extraction, etc.). In the embodiment illustrated in FIGS. 2A and 2B, the first lint filter 22 is inserted into the first lint filter housing 42 below the opening 38 while in the use position 44, as illustrated in FIG. 2A, and is removed from the first lint filter housing 42 in the maintenance position 46, as illustrated in FIG. 2B.

Figure 3:
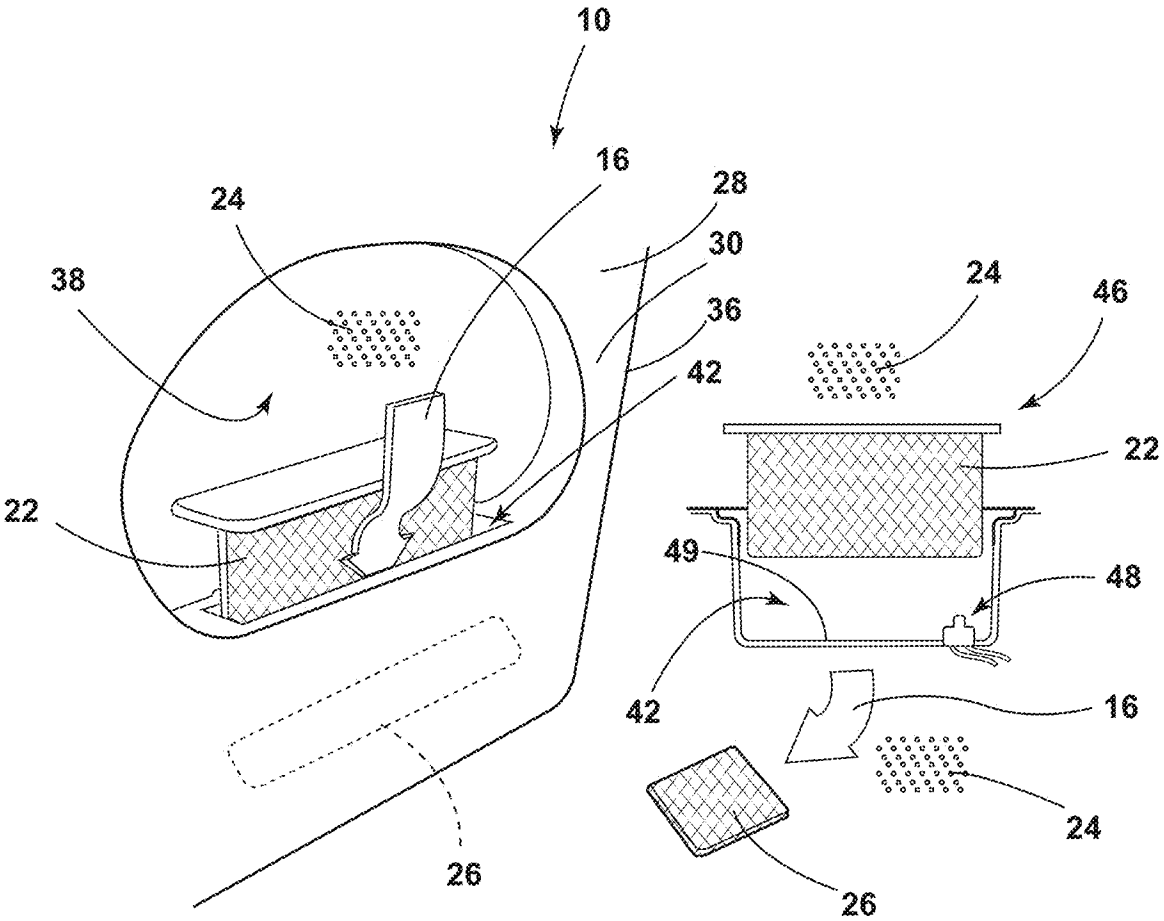
FIG. 3 is a top perspective view of a portion of a laundry appliance that includes a schematic illustrating operation of the first and second lint filters.

Referring now to FIGS. 2A-3, the laundry appliance 10 includes the second lint filter 26. The second lint filter 26 can be positioned proximate to the first lint filter 22 in the use position 44 of the first lint filter 22. In some examples, the second lint filter 26 is positioned within the airflow path 18 and downstream of the first lint filter 22, as illustrated in FIGS. 2A-3. The second lint filter 26 is configured to filter particulate matter 24 from the process air 16 delivered by the blower 14 of the laundry appliance 10. As described herein, in some embodiments, the process air 16 in the airflow path 18 is first delivered through the first lint filter 22 and then subsequently delivered through the second lint filter 26. As such, the second lint filter 26 typically is configured to filter particulate matter 24 that bypassed the first lint filter 22. Accordingly, the second lint filter 26 typically is configured to capture finer or smaller particulate matter 24 that may pass through the first lint filter 22. In other words, the second lint filter 26 can be a finer filter than the first lint filter 22.

Figure 4:
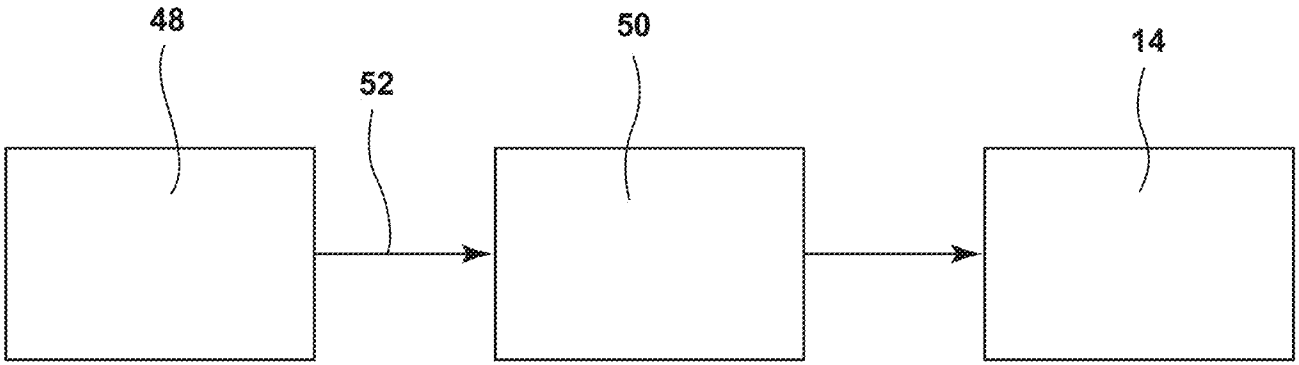
FIG. 4 is a block diagram of a controller, a switch, and a blower.

Referring now to FIGS. 3 and 4, the laundry appliance 10 includes a switch 48. The switch 48 is operable between a first condition and a second condition. In some embodiments, movement of the first lint filter 22 between the use and maintenance positions 44, 46 directly operates the switch 48, or prompts the switch 48, to operate between the first and second conditions. For example, in some embodiments, movement of the first lint filter 22 from the use position 44 to the maintenance position 46 prompts the switch 48 to enter the second condition. Further, movement of the first lint filter 22 from the maintenance position 46 to the use position 44 prompts the switch 48 to enter the first condition. In various embodiments, the switch 48 is closed in the first condition and open in the second condition. It is contemplated that the switch 48 can be open in the first condition and closed in the second condition, in some embodiments.

Referring still to FIGS. 3 and 4, it is contemplated that the switch 48 can be at least one of a variety of switch types (e.g., toggle switch, proximity switch, push-button switch, etc.). In the embodiment illustrated in FIG. 3, the switch 48 is a push-button switch 48 that is disposed at a bottom 49 of the first lint filter housing 42. In operation, the first lint filter 22 compresses a push-button mechanism of the switch 48 in the use position, which causes the switch 48 to be moved into the first condition. As the first lint filter 22 is moved from the use position 44 toward the maintenance position 46, as illustrated in FIG. 3, the contact between the first lint filter 22 and the switch 48 is removed, which allows the push-button mechanism to decompress causing the switch 48 to enter the second condition from the first condition. It is contemplated that the switch 48 can be located at a variety of positions on the laundry appliance 10, in various embodiments.

Referring now to FIG. 4, the switch 48 can be electrically coupled with the blower 14, such that the switch 48 being in the first condition and/or the second condition can affect operation of the blower 14. For example, in the embodiment illustrated in FIG. 4, the laundry appliance 10 includes a controller 50 that is electrically coupled with the blower 14 and the switch 48. The controller 50 is configured to receive inputs 52 and prompt outputs to control components of laundry appliance 10. In an exemplary embodiment, the controller 50 is operable to receive inputs 52 from the switch 48 and control operation of the blower 14 based on the inputs 52 received from the switch 48. In an exemplary embodiment, the controller 50 prompts the blower 14 to deliver process air 16 through the second lint filter 26 in the second condition of the switch 48. In other words, the controller 50 is configured to prompt activation of the blower 14 in response to receiving an input 52 that the switch 48 has switched from the first condition to the second condition.

In some embodiments, the blower 14 is a variable speed blower. In other words, the blower 14 is operable to deliver process air 16 through the airflow path 18 at varying speeds. In an exemplary embodiment of the laundry appliance 10, the blower 14 delivers process air 16 through the airflow path 18 at a first speed during general operation of the laundry appliance 10, wherein laundry is being processed within the drum 12, and the blower 14 is configured to deliver process air 16 through the airflow path 18, or at least a portion of the airflow path, at a second speed that is slower than the first speed in a secondary operation mode, such as in response to the switch 48 switching from the first condition to the second condition.

In operation of an exemplary embodiment of the laundry appliance 10, a user loads laundry into the drum 12 of the laundry appliance 10 and turns the laundry appliance 10 on to dry the laundry. The blower 14 operates at a first speed to deliver process air 16 into the drum 12. The process air 16 flows out of the drum 12, through the first lint filter 22, and, subsequently, through the second lint filter 26 before ultimately being expelled from the airflow path 18 by the blower 14 (or recycled through the airflow path 18, where applicable). As the process air 16 flows through the first and second lint filters 22, 26, particulate matter 24 (e.g., lint) is filtered from the process air 16 by the first and second lint filters 22, 26. Upon completion of the drying cycle of the laundry appliance 10, the user moves the first lint filter 22 from the use position 44, as illustrated in FIG. 2A, to the maintenance position 46, as illustrated in FIG. 2B, to remove the particulate matter 24 from the first lint filter 22. Prior to the user removing the first lint filter 22 from the use position 44, the first lint filter 22 was compressing the push-button switch 48, such that the switch 48 was in the first condition. As the user moves the first lint filter 22 from the use position 44 toward the maintenance position 46, the contact between the push-button switch 48 and the first lint filter 22 ceases, which prompts the push-button mechanism to decompress. Decompression of the push-button mechanism causes the switch 48 to enter the second condition. As the switch 48 enters the second condition, the controller 50 receives an input 52 from the switch 48 indicating that the switch 48 has entered the second condition. In response, the controller 50 prompts activation of the blower 14 at a second speed that is slower than the first speed. The blower 14 delivers process air 16 into a portion of the airflow path 18 via the now vacated first lint filter housing 42 and through the second lint filter 26, such that particulate matter 24 that sloughs off of the first lint filter 22 as the first lint filter 22 is removed from the use position 44 is drawn into the second lint filter 26.

Figure 6:
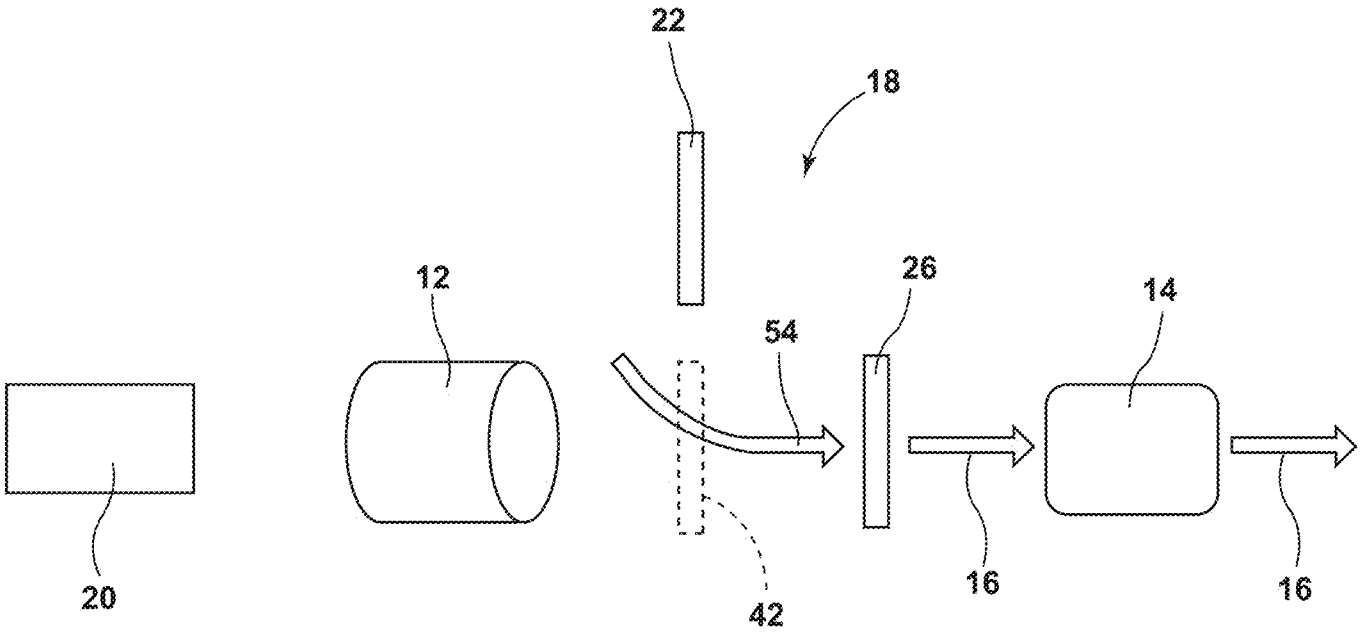
FIG. 6 is a schematic diagram of an ambient airflow path for a laundry appliance including a first lint filter in a maintenance position and a second lint filter.

Referring now to FIG. 6, typically, when the first lint filter 22 is removed, the door 40 is open. Accordingly, operation of the blower 14 at the second speed when the switch 48 is in the second condition tends to draw ambient air 54 from the atmosphere, into the first lint filter housing 42 and toward the second lint filter 26. The movement of this ambient air 54 assists in drawing the sloughed-off particulate matter 24 away from the drum 12 and areas around the laundry appliance 10 and into the second lint filter 26, as illustrated in FIG. 6.

In some implementations, the position of the door 40 in combination with the condition of the switch 48 can cause the controller 50 to override user-inputted requests to operate the laundry appliance 10. In an exemplary embodiment, if the controller 50 receives a user-inputted request to initiate a drying cycle while the door 40 is in the closed position and the switch 48 is in the second condition (indicating that the first lint filter 22 is not in the use position 44), the controller 50 prompts emission of an alert instead of activating the blower 14 to execute the drying cycle request. As a result, operation of the laundry appliance 10 while the first lint filter 22 is not in the use position 44 can be avoided.

The laundry appliance 10 of the present disclosure can provide a variety of advantages. First, the variable speed blower 14 allows for blower speeds that are suitable for a variety of applications, which can save energy. Second, activation of the blower 14 as the first lint filter 22 is moved from the use position 44 to the maintenance position 46 can corral free-floating particulate matter 24 that sloughs off of the first lint filter 22 by drawing the free-floating particulate matter 24 into the second lint filter 26. It is contemplated that the laundry appliance 10 can include a second, lower-speed blower (not shown) that operates instead of, or in combination with, the blower 14 to corral free-floating particulate matter 24 by delivering the particulate matter 24 into the second lint filter 26 while the first lint filter 22 is in the maintenance position 46. In some embodiments, the blower 14 and the second blower can be single-speed blowers.

According to one aspect of the present disclosure, a laundry appliance includes a first lint filter operable between a use position and a maintenance position, a second lint filter proximate to the first lint filter, a switch operable between a first condition and a second condition, and a blower. Movement of the first lint filter from the use position to the maintenance position prompts the switch to enter the second condition from the first condition. The blower is operable to deliver process air through the first and second lint filters in the first condition of the switch and is configured to activate to deliver process air through the second lint filter based on the switch entering the second condition.

According to another aspect, the laundry appliance further includes a controller electrically coupled with the blower and the switch. The controller is configured to prompt the blower to deliver process air at a first speed based on the switch being in the first condition, and is further configured to prompt the blower to deliver process air at a second speed that is different than the first speed based on the switch being in the second condition.

According to another aspect, the first speed is greater than the second speed.

According to another aspect, the laundry appliance further includes a cabinet having a front side that defines an opening, and a drum housed within the cabinet and accessible via the opening.

According to another aspect, the laundry appliance further includes a first lint filter housing coupled to the cabinet and positioned below the opening defined by the front side of the cabinet. The first lint filter is positioned below the opening within the first lint filter housing in the use position.

According to another aspect, the switch comprises a push-button switch disposed at a bottom of the first lint filter housing. The push-button switch is compressed by the first lint filter in the use position of the first lint filter such that the push-button switch is in the first condition, and the push-button switch is decompressed in the maintenance position of the first lint filter such that the push-button switch is in the second condition.

According to another aspect, the second lint filter is finer than the first lint filter.

According to another aspect of the present disclosure, a laundry appliance includes a first lint filter operable between a use position and a maintenance position, a second lint filter proximate to the first lint filter, a switch operable between a first condition and a second condition, and a blower configured to deliver process air through the second lint filter in the second condition of the switch. Movement of the first lint filter from the use position to the maintenance position prompts the switch to enter the second condition.

According to another aspect, the blower is operable to deliver air through the first and second lint filters in the first condition of the switch.

According to another aspect, the laundry appliance further includes a controller electrically coupled with the blower and the switch. The controller is configured to prompt the blower to deliver process air at a first speed based on the switch being in the first condition, and is further configured to prompt the blower to deliver process air at a second speed that is different than the first speed based on the switch being in the second condition.

According to another aspect, the first speed is greater than the second speed.

According to another aspect, the laundry appliance further includes a cabinet having a front side that defines an opening, and a drum housed within the cabinet and accessible via the opening.

According to another aspect, the laundry appliance further includes a first lint filter housing coupled to the cabinet and positioned below the opening defined by the front side of the cabinet. The first lint filter is positioned below the opening within the first lint filter housing in the use position.

According to another aspect, the switch comprises a push-button switch disposed at a bottom of the first lint filter housing. The push-button switch is compressed by the first lint filter in the use position of the first lint filter such that the push-button switch is in the first condition, and the push-button switch is decompressed in the maintenance position of the first lint filter such that the push-button switch is in the second condition.

According to another aspect, the second lint filter is finer than the first lint filter.

According to yet another aspect of the present disclosure, a laundry appliance includes a blower for delivering process air through an air flow path, and a first lint filter operable between a use position and a maintenance position. In the use position, the first lint filter is positioned within the air flow path. In the maintenance position, the first lint filter is positioned such that captured particulate matter is accessible for removal from the first lint filter by a user. Movement of the first lint filter from the use position to the maintenance position prompts activation of the blower.

According to another aspect, the laundry appliance further includes a second lint filter positioned proximate to the first lint filter. The blower is configured to deliver process air through the second lint filter in the maintenance position of the first lint filter.

According to another aspect, the blower is configured to deliver process air through the first and second lint filters in the use position of the first lint filter.

According to another aspect, the blower is configured to deliver the process air through the first and second lint filters at a first speed in the use position of the first lint filter during general operation of the laundry appliance, and the blower is configured to deliver the process air through the second lint filter at a second speed that is different than the first speed in the maintenance position of the first lint filter.

According to another aspect, the first speed is greater than the second speed.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a first lint filter operable between a use position and a maintenance position;

a second lint filter proximate to the first lint filter;

a switch operable between a first condition and a second condition, wherein movement of the first lint filter from the use position to the maintenance position prompts the switch to enter the second condition from the first condition; and a blower operable to deliver process air through the first and second lint filters in the first condition of the switch and configured to activate to deliver process air through the second lint filter based on the switch entering the second condition.

2. The laundry appliance of claim 1, further comprising:
a controller electrically coupled with the blower and the switch and configured to:
prompt the blower to deliver process air at a first speed based on the switch being in the first condition; and
prompt the blower to deliver process air at a second speed that is different than the first speed based on the switch being in the second condition.

3. The laundry appliance of claim 2, wherein the first speed is greater than the second speed.

4. The laundry appliance of claim 1, further comprising:
a cabinet having a front side that defines an opening; and
a drum housed within the cabinet and accessible via the opening.

5. The laundry appliance of claim 4, further comprising:
a first lint filter housing coupled to the cabinet and positioned below the opening defined by the front side of the cabinet, wherein the first lint filter is positioned below the opening within the first lint filter housing in the use position.

6. The laundry appliance of claim 5, wherein the switch comprises:
a push-button switch disposed at a bottom of the first lint filter housing, wherein the push-button switch is compressed by the first lint filter in the use position of the first lint filter such that the push-button switch is in the first condition, and the push-button switch is decompressed in the maintenance position of the first lint filter such that the push-button switch is in the second condition.

7. The laundry appliance of claim 1, wherein the second lint filter includes a filtration media that is finer than that of the first lint filter.

8. A laundry appliance, comprising:
a first lint filter operable between a use position and a maintenance position;
a second lint filter proximate to the first lint filter;
a switch operable between a first condition and a second condition; and
a blower configured to deliver process air through the second lint filter in the second condition of the switch, wherein movement of the first lint filter from the use position to the maintenance position prompts the switch to enter the second condition.

9. The laundry appliance of claim 8, wherein the blower is operable to deliver air through the first and second lint filters in the first condition of the switch.

10. The laundry appliance of claim 9, further comprising:
a controller electrically coupled with the blower and the switch and configured to:
prompt the blower to deliver process air at a first speed based on the switch being in the first condition; and
prompt the blower to deliver process air at a second speed that is different than the first speed based on the switch being in the second condition.

11. The laundry appliance of claim 10, wherein the first speed is greater than the second speed.

12. The laundry appliance of claim 8, further comprising:
a cabinet having a front side that defines an opening; and
a drum housed within the cabinet and accessible via the opening.

13. The laundry appliance of claim 12, further comprising:
a first lint filter housing coupled to the cabinet and positioned below the opening defined by the front side of the cabinet, wherein the first lint filter is positioned below the opening within the first lint filter housing in the use position.

14. The laundry appliance of claim 13, wherein the switch comprises:
a push-button switch disposed at a bottom of the first lint filter housing, wherein the push-button switch is compressed by the first lint filter in the use position of the first lint filter such that the push-button switch is in the first condition, and the push-button switch is decompressed in the maintenance position of the first lint filter such that the push-button switch is in the second condition.

15. The laundry appliance of claim 8, wherein the second lint filter includes a finer filtration media than that of the first lint filter.

16. A laundry appliance, comprising:
a blower for delivering process air through an air flow path;
a first lint filter operable between a use position, wherein the first lint filter is positioned within the air flow path, and a maintenance position, wherein the first lint filter is positioned such that captured particulate matter is accessible for removal from the first lint filter by a user; and
a switch operable between a first condition and a second condition, wherein movement of the first lint filter from the use position to the maintenance position prompts the switch to enter the second condition from the first condition, and wherein the switch entering the second condition prompts activation of the blower.

17. The laundry appliance of claim 16, further comprising:
a second lint filter positioned proximate to the first lint filter, wherein the blower is configured to deliver process air through the second lint filter in the maintenance position of the first lint filter.

18. Laundry appliance of claim 17, wherein the blower is configured to deliver process air through the first and second lint filters in the use position of the first lint filter.

19. The laundry appliance of claim 18, wherein the blower is configured to deliver the process air through the first and second lint filters at a first speed in the use position of the first lint filter during general operation of the laundry appliance, and the blower is configured to deliver the process air through the second lint filter at a second speed that is different than the first speed in the maintenance position of the first lint filter.

20. The laundry appliance of claim 19, wherein the first speed is greater than the second speed.

* * * * *